United States Patent [19]

Rechtsteiner et al.

[11] 4,047,547

[45] Sept. 13, 1977

[54] METHOD OF FILLING, SAMPLING AND SEALING AN ASEPTIC TANK

[76] Inventors: Steve A. Rechtsteiner, 1920 Gainsborough Lane, Cincinnati, Ohio 45230; Philip E. Nelson, 911 Garden St.; John R. Heron, 1016 Lindberg Road, both of West Lafayette, Ind. 47906

[21] Appl. No.: 668,950

[22] Filed: Mar. 22, 1976

Related U.S. Application Data

[62] Division of Ser. No. 598,049, July 22, 1975, which is a division of Ser. No. 496,654, Aug. 12, 1974, Pat. No. 3,951,184.

[51] Int. Cl.[2] ..... B65B 3/04

[52] U.S. Cl. ..... 141/1; 21/58; 73/421 R

[58] Field of Search ..... 21/58, 59, 104; 141/1 R, 11, 47–49, 83, 85, 89–92, 392; 137/15, 240; 73/421 R

[56] References Cited

U.S. PATENT DOCUMENTS 3,166,106 1/1965 Reeve et al. ..... 141/91

*Primary Examiner*—Houston S. Bell, Jr.
*Attorney, Agent, or Firm*—Wood, Herron & Evans

[57] ABSTRACT

The method of this invention includes aseptically sealing an empty sterilized tank while maintaining asepsis of the tank, and thereafter connecting a product line to an opening in the tank, sterilizing the product line while so connected, and filling the tank with sterile product from the product line, all without destroying the aseptic condition of the tank. In addition, the method includes sampling the product in the product line during the tank filling operation while maintaining asepsis of both the product line and the tank. Finally, the method includes sealing the tank when full of sterile product, removing samples of sterile product from the tank subsequent to its filling and resealing the tank after each such sampling operation. Asepsis is maintained during each of the tank sealing, tank sampling and tank re-sampling operations.

4 Claims, 65 Drawing Figures

METHOD OF FILLING, SAMPLING AND SEALING AN ASEPTIC TANK

This is a division, of application Ser. No. 598,049, filed July 22, 1975, which is a divisional of Ser. No. 496,654, filed Aug. 12, 1974, now U.S. Pat. No. 3,951,184.

This invention relates to the aseptic storage of bulk material, and more particularly to a method of sealing, sampling and filling an aseptic storage tank with sterile product without destroying asepsis of either the sterile product or the tank and its associated valves.

In the processing of edible material, and prior to finally packaging smaller packages for consumer use, it is often necessary to store large quantities of a material in bulk form and to do so under aseptic conditions to insure ultimate purity of the material as supplied to the consumer. Often the edible bulk material must remain in the storage tank for protracted periods of time such as the case with, for example, tomato products, fruit and the like which are sold throughout the year, yet are available for harvesting during only a few months.

In view of the protracted nature of this storage, it is important that all possible steps be taken to avoid admission into the tank of contaminants, such as micro-organisms, which when admitted in only small quantities will eventually contaminate the entire tank. To this end, it has been the practice in aseptic bulk storage system to provide, among other things, valves for controlling the flow of bulk material to and from the tank which incorporate structural features specifically designed to prevent the infiltration of contaminants into the interior of the valve via various joints which exist between the movable components of the assembled valve structure, such as at the interface between the movable valve stem and the bore in the valve body in which the movable stem slidably interfits. Illustrative of a valve incorporating such aseptic construction is that disclosed and claimed in Nelson U.S. Pat. No. 3,667,895 and in Rechtsteiner et al U.S. Pat. application Ser. No. 467,460, filed May 6, 1974, entitled "Aseptic Bulk Material Storage System and Improved Aseptic Valve Therefor."

It has further been the practice in aseptic storage systems to substitute, with micro-biologically filtered oxygen-free inert gas, oxygen-containing air which collects in partially filled tanks in the unused volume above the bulk material. By removing oxygen from the unused portion of the tank above the bulk material, multiplication of contaminants, such as micro-organisms within the tank is inhibited. The oxygen-free inert gas, preferably nitrogen, since it is customarily supplied from a non-aseptic pressurized supply, is filtered with a micro-biological filter prior to admission into the tank. An improved nitrogen filter incorporating features specifically designed to maintain tank asepsis is disclosed and claimed in the copending Rechtsteiner et al U.S. Pat. application Ser. No. 466,672 filed May 3, 1974, entitled "Aseptic Storage System for Bulk Materials and Improved Micro-Biological Filter Therefor."

Bulk storage tanks used in aseptic storage typicially include suitable accessory fittings, such as transparent windows with which to view the interior of the tank, rupture elements which will vent the tank in the event it becomes over-pressurized thereby preventing rupture of the tank, manholes in the top of the tank to permit, when the tank is empty, access to the tank interior for routeine cleaning and repair, etc.. To further promote the storage of bulk materials under aseptic conditions an improved method has been developed to sterilize fittings associated with an aseptic storage tank and connect them to the tank such that asepsis of the tank interior is maintained subsequent to their interconnection. Such a method is disclosed and claimed in the copending U.S. Pat. application in the name of Rechtsteiner et al Ser. No. 480,842, filed June 19, 1974, entitled "Method of Aseptically Connecting a Fitting to an Aseptic Storge Tank."

Thus, it is apparent that extreme precautions must be taken with respect to all the components of an aseptic storage installation, as well as all aspects of the aseptic storage process including tank filling, sealing and sampling, to avoid the introduction of contaminants into the tank and its associated valves and fittings and the resulting risk of contamination of the stored product. For example, subsequent to sterilization of an empty tank, it is essential that the tank be aseptically sealed, since it may be some time before it is filled with sterile product and if asepsis is not maintained in the interim contamination may result. It is also important that when the empty aseptic storage tank is connected to a source of sterile product to facilitate tank filling that such be accomplished without destroying the asepsis of either the empty storage tank or the sterile product supply and associated valves and fittings. Likewise, it is essential that during the actual tank filling operation, which may take many hours, samples of the sterile product be removed periodically for remote testing and analysis, and that such sampling not destroy the aseptic nature of either the product supply line, tank and associated valves and fittings, or the sample container. Similarly, it is important that after the tank is filled it be sealed without destroying the aseptic condition of the tank and its stored product, and further that samples be withdrawn from the filled and sealed tank on a periodic basis, such as once each week, and that the tank be resealed following each sample without introducing contaminants into either the storage tank and its associated valves and fittings or the container into which the sample is placed after it is withdrawn from the tank.

Accordingly, it is an objective of this invention to provide an improved method of aseptically sealing, sampling and filling an aseptic storage tank with sterile product without destroying the aseptic condition of either the sterile tank and associated valves and fittings, the product supply line, or the sampling equipment. This objective has been accomplished, in part, by providing an improved method of aseptically sealing a sterile storage tank, whether empty or containing sterile product, which comprehends connecting first and second aseptic valves in series with an opening in the tank through which the bulk material passes during the filling and/or emptying process. The first valve, which is connected to the tank and has a cavity housing the valve closure element, is closed to seal the valve cavity relative to the tank opening with respect to which the first valve communicates when open. Chemical sterilant in liquid form is introduced into the valve cavities of both the first and second valves to sterilize and to establish first and second aseptic barriers arranged in tandem between the tank opening and the environment. Thereafter the second valve is closed to seal the second valve cavity from the first valve cavity. Additionally, a port of the second valve, which during tank filling and/or sampling connects to the product supply and/or sampling equipment, is capped to completely seal the sterilant-filled second valve cavity, thereby completing the sealing of the tank and the provision thereof with two independent tandem aseptic barriers between the tank opening and the environment.

It has been a further objective of this invention to provide an improved method of extracting a sample of stored product from a filled tank which has been sealed in accordance with the method outlined above, and to do so without destroying asepsis of either the stored product or the sampling equipment. This objective has been accomplished in accordance with a further aspect of the invention by unsealing a port in the second valve, connecting a third valve to the unsealed port to establish alternate flow paths including (a) a first flow path between the unsealed port and the environment and (b) a second flow path between the unsealed port and a sample container. Liquid chemical sterilant is then introduced into the second valve cavity via the first flow path to sterilize the second valve cavity and the connecting port of the third valve. Following this, the third valve is operated to establish the second flow path between the sample container and the third valve. Thereafter, the first valve, which normally seals the tank opening, is opened to permit sterile product from the tank to enter the sample container via the first and second valve cavities and the second flow path established by the third valve. When the sample container has been filled, the first valve is closed to terminate the flow of sterile product from the tank and the third valve is operated to reestablish the first flow path and seal the sample container. The third valve is then disconnected from the second valve and liquid chemical sterilant introduced into the first and second valve cavities to re-sterilize and re-establish the first and second tandem aseptic barriers between the environment and the tank opening. Following this the second valve is closed to seal the second valve cavity from the first valve cavity and the port to which the third valve was connected is sealed to complete sealing of the second valve cavity. Thus, a sterile product sample is taken from a sealed and filled tank, and the tank resealed, without destroying the aseptic condition of the tank and its contents.

A further objective of the invention is to provide an improved method of sterilizing a product line connectable to supply sterile product to an aseptic tank via first and second valves series connected between the product line and an opening of the tank. The improved method incudes filling the valve cavity of the first valve, which connects to the tank opening, with liquid chemical sterilant to establish an aseptic barrier between the tank opening and the second valve. The second valve is closed to seal the cavity thereof from the first valve cavity which constitutes the aseptic barrier. The product line is connected to a port in the second valve in communication with the second valve cavity. Liquid sterilant is then circulated through both the product line and the second valve cavity to sterilize each, while maintaining the second valve closed to aseptically isolate the tank interior from the product line during product line sterilization, the aseptic isolation being accomplished by the sterilant-filled cavity of the first valve. Thus, the product supply line is sterilized without destroying the aseptic condition of the sealed, previously sterilized tank.

A further objective of the invention has been to provide an improved method of filling an empty aseptic tank which previously has been sealed in a manner providing a tandem chemical block, or aseptic barrier, between the tank opening and the environment, as described previously. In accordance with this aspect of the invention, the second valve, in the cavity of which liquid chemical sterilant is normally present to establish the second or outer aseptic barrier, is disconnected from the first valve. The chemical sterilant in the first valve, which normally establishes the first or inner aseptic barrier, is free to drain since the first valve cavity is no longer sealed by the second valve. A third valve is then connected in series with the first valve, and a fourth valve connected in series with the third valve. The valve cavities of all valves are filled with chemical sterilant to sterilize them, whereupon the third valve is closed to seal the first valve cavity and establish a sealed chemical sterilant barrier between the tank opening and the environment. A fifth valve is connected in series with the fourth valve via a sample port in the fifth valve, which port is normally sealed by the fourth valve when connected thereto. The fifth valve has a valve closure element establishing alternate fluid flow paths including (a) a first path between the environment and the sample port connecting to the fourth valve cavity and (b) a second path between the sample container and the sample port connecting to the fourth valve cavity. Chemical sterilant is introduced into the first fluid flow path of the fifth valve to sterilize the sample port and the fourth valve cavity. The fifth valve is then operated to establish the second flow path connecting the fourth valve cavity to the sample container. The sterile product is fed into the third valve cavity where it flows into the tank via the first valve and into the sample container by the fourth and fifth valves. When the sample container is filled, the fifth valve is operated to establish the first flow path, sealing the sample container, and the fourth valve is closed. The tank continues filling since the first and third valves remain open. Thus, a sterile product sample is taken without interrupting or destroying asepsis of the tank filling operation.

These and other advantages, features and objectives of the invention will become more readily apparent from a detailed description thereof taken in connecton with the following description of the drawings in which:

FIGS. 1–43 depict, in schematic form, the varying conditions of the aseptic tank and associated valves during different phases of the method of this invention, including each of the following method steps and/or sequences:

1. Standby, or empty sterile tank, condition (FIG. 1),
2. Pre-fill sequence (FIGS. 2–12),
3. Tank-filling sequence (FIG. 13),
4. Product supply sampling sequence (FIGS. 14–19A),
5. Product supply resampling sequence (FIGS. 20–22),
6. Filled-tank sealing sequence (FIGS. 23–29),
7. Filled-tank sampling sequence (FIGS. 30–39, and
8. Filled-tank resealing sequence (FIGS. 40–43).

Figure 1:
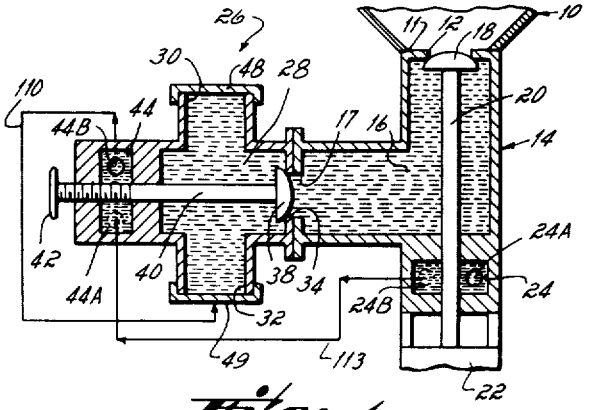
FIG. 1 is an elevational view, in cross section, of a preferred aseptic storage system useful in practicing the method of this invention, showing the aseptic tank and associated valves in the standby, or sterile tank, condition.

The preferred apparatus employed in practicing the method of this invention, e.g., as shown in FIG. 1, includes an aseptic storage tank 10 capable of storing large quantities, e.g., 20,000–100,000 gallons or more, of previously sterilized bulk material, or product. A suitable aseptic storage tank 10 is described in the copending application of S. A. Rechtsteiner et al, Ser. No. 480,842, filed June 19, 1974, entitled "Method of Aseptically Connecting a Fitting to an Aseptic Tank," the entire disclosure of which is incorporated herein by reference. The tank 10, only the funnel-shaped bottom section of which is shown in the figures, includes a port or opening 11 through which sterile product passes in the course of filling and emptying the tank with product.

Secured in the tank in the region below the opening 11 is an aseptic tank drain valve 14. This valve is employed in all the steps or the method of this invention depicted in FIGS. 1–43. The valve 14 includes, among other things, an internal cavity 16 in which a valve closure plug 18 reciprocates between an upper, closed position (e.g., FIG. 1) sealing a valve port 12 which underlies the tank opening 11, and a lower open position (e.g., FIG. 13A) in which the valve port 12, and hence the opening 11 is unsealed. A valve stem 20 connected at its upper end to the plug 18 passes through a suitably provided bore in the body of valve 14 for connection to a valve actuator 22, preferably pneumatically operated, which is secured to the exterior of the valve body. Formed in the body of valve 14 surrounding the stem 20 is a valve stem sterilization chamber 24 which, when filled with chemical sterilant, provides an aseptic barrier around the stem between the valve chamber 16 and the valve environment. The valve stem sterilization chamber 24 includes a sterilant inlet port 24A and a sterilant outlet port 24B which facilitates the circulation of fresh sterilant through the chamber 24 when a source of sterilant CS (E.g., FIG. 4A) is connected to inlet port 24A.

The aseptic valve 14 preferably is of the type described in the copending application of S. A. Rechtsteiner et al, Ser. No. 467,460, filed May 6, 1974, entitled "Aseptic Bulk Material Storage System and Valve Therefor," the entire disclosure of which is expressly incorporated herein by reference.

A preferred method of circulating sterilant through the aseptic valve sterilant chamber 24 is described in Nelson, U.S. Pat. No. 3,678,955, issued July 25, 1972, entitled "Aseptic Storage and Valving System."

Associated with the tank drain valve 14 during the standby, or empty sterile tank, condition shown in FIG. 1 and during the steps depicted in FIGS. 27–43 is an aseptic seal valve 26 having an internal chamber 28 which communicates with a pair of oppositely disposed ports 30 and 32, and with a port 34 which is selectively sealed with a plug 38. A stem 40 secured at one end to the plug 38 passes through a suitably provided bore in the body of the valve 26 and terminates in a handle 42 exteriorly of the valve body. The outer portion of the stem 40 is threaded to facilitate reciprocation of the plug 38 between its inner, port-sealing position (e.g., FIG. 1) and its outer, nonsealing position (e.g., FIG. 40) when the stem 40 is rotated manually with the handle 42. When the valve plug 38 is in its retracted position which occurs during certain steps of the method of this invention (e.g., FIG. 40), the cavity 16 of valve 14 communicates with the cavity 28 of valve 26 via aligned ports 34 and 17. A valve stem sterilant chamber 44, having an inlet opening 44A and an outlet opening 44B, is provided in the body of valve 26 surrounding stem 40 for the same purpose that the sterilization chamber 24 is provided in value 14. Caps 48 and 49 are provided to selectively seal ports 30 and 32.

Figure 2:
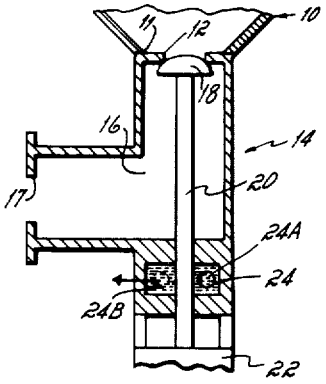
FIGS. 2–12 are elevational views, in cross section, of the aseptic tank and associated valves during different phases of the pre-fill sequence.
Figure 3:
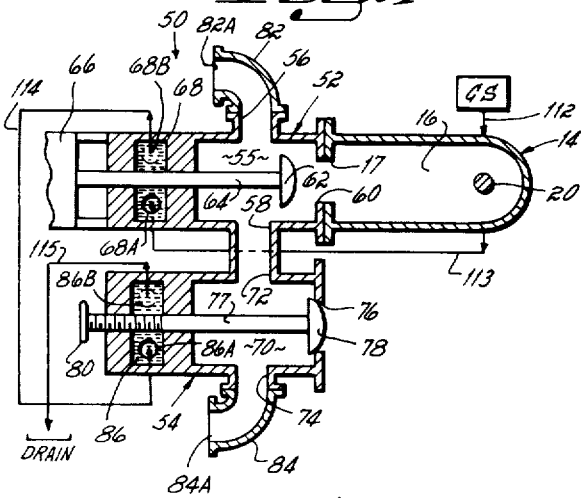

Also included in the preferred embodiment of the apparatus suitable for practicing the method of this invention is an aseptic tank-fill valve/sample valve assembly 50 shown in FIG. 3 as well as in other figures. The assembly 50 includes an aseptic tank-fill valve 52 and an aseptic sample valve 54 which are preferably secured to each other forming a unitary dual valve assembly. The valve assembly 50, in particular tank fill valve 52, is connected to the port 17 of the tank drain valve 14 during the steps of the method of this invention depicted in FIGS. 2–26.

Figure 5:
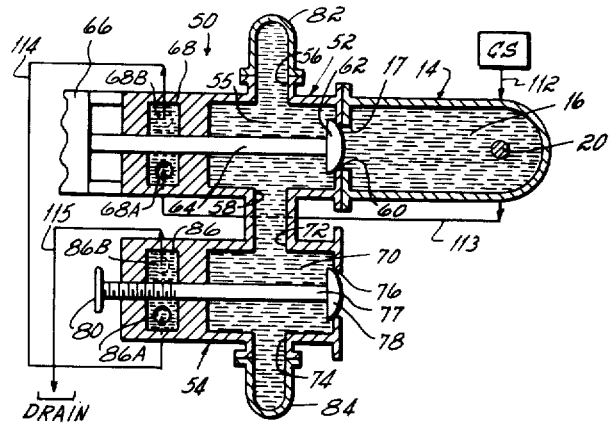

Value 52 includes an internal chamber 55 which communicates with oppositely disposed ports 56 and 58, and with a port 60 which, when valve 52 is mounted to valve 14, is aligned with port 17 Port 60 is selectively sealed by a plug 62 which is movable between an unsealed position (e.g., FIG. 3) and a sealed condition (e.g., FIG. 5.) The plug 62 is secured to the inner end of a valve stem 64 which reciprocates in a suitably provided bore of the body of valve 52. The outer end of the valve stem 64 connects to an actuator 66, preferably of the pneumatic type, which is mounted to the valve body. Surrounding the valve stem 64 and formed in the body of valve 52 is a sterilant chamber 68 having an input port 68A and output port 68B through which chemical sterilant circulates to establish a sterile barrier around the axially shiftable valve stem 64. Chamber 68 of valve 52 serves the same function as chambers 24 and 44 of valves 14 and 26.

Figure 7:
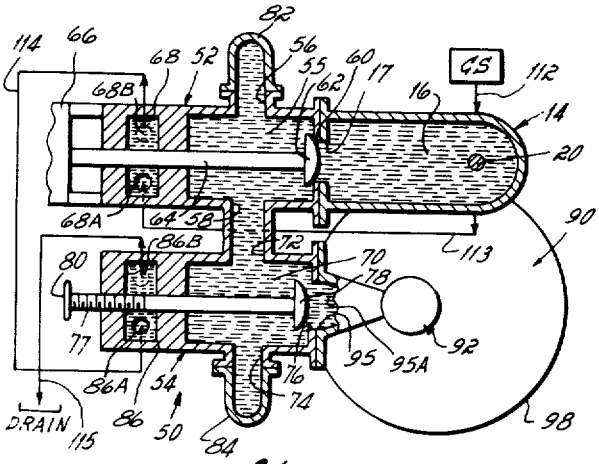

The valve 54 includes an internal chamber 70 communicating with oppositely disposed ports 72 and 74, and with a port 76 which is selectively sealed by a valve plug 78 movable between an inner sealed position (e.g., FIG. 3) and an outer unsealed position (e.g., FIG. 7). A valve stem 77 secured at its inner end to the plug 78 is provided for moving the valve plug 78 between its sealing and unsealing positions. The valve stem 77 passes through a suitably provided bore in the body of valve 54, terminating in a handle 80. The outer end of the valve stem 77 is threaded for facilitating advancement and retraction of the valve stem 77, and hence the valve plug 78, when the handle 80 is rotated. Surrounding the valve stem 77 and formed in the body of valve 54 is sterilant chamber 86 having an inlet port 86A and an outlet port 86B to facilitate circulation of sterilant through the chamber 86 to establish a sterile barrier around the axially shiftable valve stem 77.

For reasons to become apparent hereafter, elbows 82 and 84 communicating with ports 56 and 74 of valve 52 and 54 are provided. The elbows 82 and 84 are rotatable relative to valve ports 56 and 74 between a position in which their outer ends 82A and 84A are disposed upwardly (e.g., FIG. 4) to prevent drainage of sterilant in valve cavities 55 and 70 of valves 52 and 54, and a position in which the valve openings 82A and 84A are disposed laterally and/or downwardly to facilitate gravity drainage of sterilant from the valve chamber 55 and 70.

Aseptic valves 52 and 54 are preferably of the type disclosed in the above-referenced Rechtsteiner et al application entitled "Aseptic Bulk Material Storage System and Valve Therefor." Also included in the preferred apparatus suitable for practicing the method of this invention is a jar valve assembly 90. Jar valve assembly 90 is utilized in the method steps depicted in FIGS. 6–18A, relating to the sampling of the product supply during tank filling, in the steps depicted in FIGS. 20–21A relating to re-sampling of the product supply during tank filling, and in the steps depicted in steps 32–38A relating to removal of a sample from a filled tank.

The jar valve assembly 90 includes a jar valve 92 and a jar 94. The jar valve 92 has a port 95 which, when the jar valve is connected to a sample valve 54 (e.g., FIG. 6A), is in alignment with the port 76 and a port 96 which communicates with the interior of the jar 94 when the jar is threaded into a suitable coupling element 98 secured to a flange 100 surrounding port 96. The jar valve 92 further includes a vertical stepped-diameter bore 102 having a reduced diameter section 102A in the lower region thereof and an enlarged diameter secton 102B in the upper region thereof. Positioned within the bore 102 is a vertically-shiftable plug element 104 which slides in the reduced diameter bore section 102A. A handle 106 extending outwardly from the valve element 104 through a slot 108 in the upper section 102B of the bore 102 is provided for conveniently shifting the valve element 104 between a lower position (e.g., FIG. 6A) and an upper position (e.g., FIG. 17A). In the lower position of valve element 104 (e.g., FIG. 6A) port 95 communicates with the environment via a through passage 104A formed in plug 104. The passage 104A, when valve element 104 is in its lower position, facilitates flooding the cavity 95A with sterilant, introduced via the upper end of passage 104A to bathe the port 76 of valve 54 when the jar valve assembly 90 is connected thereto and its associated plug 78 is in its port-unsealing position (e.g., FIG. 7A).

In the upper position of valve element 104 (e.g., FIG. 17A) the interior of jar 94 communicates with port 95 to facilitate passage into the jar of the product to be sampled from the valve to which port 95 is connected. When the valve element 104 is in its upper position (e.g., FIG. 17A), port 95 does not communicate with bore 104A, thereby preventing the product entering port 95 from passing to the atmosphere via passage 104A.

The annular cavity 107 located between bore 102B and valve element 104 can be filled with sterilant (e.g., FIG. 9A), by pouring it into the top thereof, to provide a sterile barrier between the environment and the interface 105 of bore 102 and valve element 104, preventing entry of contaminant into the cavity 95A via the interface 105.

The valves 14, 26, 50, 54 and 92 may be fabricated of any material, but preferably are constructed of stainless steel.

Having described a preferred form of apparatus suitable for practicing the method of this invention, a description now follows of the method steps of this invention utilized to (a) fill an aseptic tank with sterile product while periodically sampling the sterile product, (b) sealing the tank subsequent to filling, and (c) thereafter re-sampling and re-sealing the filled tank.

STANDBY, OR EMPTY STERILE TANK, CONDITION

FIG. 1 depicts the aseptic bulk storage tank 10 which has, in any suitable manner, been previously sterilized. While sterile tank 10 is sealed by placing valves 14 and 26 in their closed position, with the valve chambers 16 and 28 thereof flooded with chemical sterilant and the valve stem sterilant chambers 24 and 44 also filled with chemical sterilant. Ports 30 and 32 of valve 26 are sealed with caps 48 and 49. Valve stem sterilization chamber 24 has its input port 24A sealed by a suitable plug (not shown). A hose 113 connects output port 24B of stem sterilant chamber 24 of valve 14 to the input port 44A of sterilant chamber 44 of valve 26, while a similar hose 110 connects the output port 44B of sterilant chamber 44 to the valve chamber 28 via cap 49, a suitable port (not shown) being provided in the cap 49 to receive the hose. With hoses 113 and 110 and caps 48 and 49 connected as described and shown in FIG. 1, with stem sterilant chamber input port 24A sealed by a plug (not shown), and with the valve plugs 38 and 18 closed, there is no flow of sterilant among the sterilant-filled chambers 16, 24, 28 and 44 of valves 14 and 26.

Figure 27:
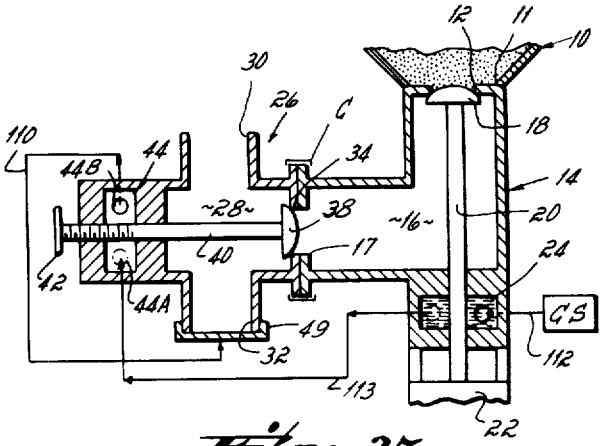
Figure 28:
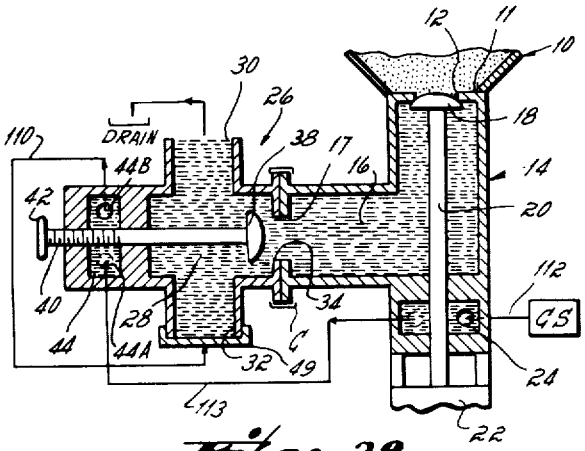
Figure 29:
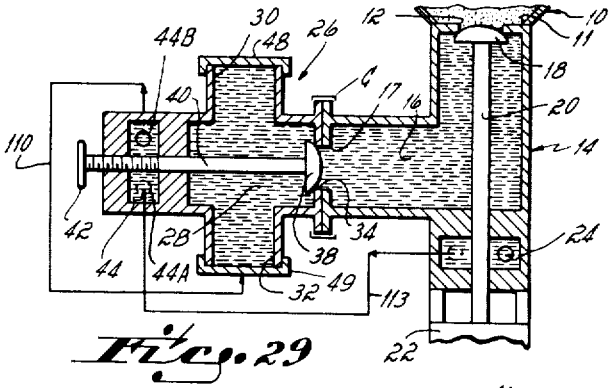

The method of achieving the standby condition of valves 14 and 26 shown in FIG. 1 is described hereafter in connection with FIGS. 27–29.

In the standby condition shown in FIG. 1, the tank opening 11 of the aseptic tank 10 is isolated from the environment by two separate sealed valve chambers 16 and 28, each filled with chemical sterilant, thereby providing a double aseptic chemical sterilant barrier or block between the tank opening 11 and the environment. Additionally, by virtue of the sterilant-filled condition of valve stem chamber 24 and 44 of valves 14 and 26, the tank opening 11 is isolated from contaminant infiltration from the environment via the bores in which the valve stems 20 and 40 are positioned.

PRE-FILL SEQUENCE

The first step of the pre-fill sequence, which sequence precedes actual filling of the tank 10 with sterile product, involves removal of the manual aseptic seal valve 26 from the tank drain valve 14 and disconnection of the hose 113 from the output port 24B of the stem sterilizatin chamber 24 of valve 14 as shown in FIG. 2. Removal of valve 26 from valve 14 and disconnection of hose 113 from chamber 24 permits the sterilant in chambers 16 and 24 of valve 14 to drain, leaving these chambers substantially devoid of sterilant.

Having removed valve 26 and disconnected hose 113 from valve 14 and drained the chambers 16 and 24, the fill/sample valve assembly 50 is mounted to the valve 14 with valve 52 open and valve 54 closed, as shown in FIG. 3. Specifically, tank fill valve 52 is connected to valve 14 such that ports 60 and 17 thereof are aligned. Additionally, the valve assembly 50 is oriented such that ports 56, 58, 72 and 74 of valves 52 and 54 lie in a common horizontal plane. A source of chemical sterilant CS is connected to a hose 112 to the input port 24A of valve stem sterilization chamber 24 of valve 14. The output port 24B of sterilization chamber 24 is connected by a hose 113 to the inlet port 68A of sterilization chamber 68 of valve 52. Output port 68B of stem sterilization chamber 68 and input port 86A of stem sterization chamber 86, if not already connected by a hose 114, are now connected by the hose 114. Finally, a hose 115 is connected to the output port 86B of stem sterilization chamber 86, to permit this latter sterilization chamber to drain as sterilant is circulated successively through sterilant chamber 24, 68 and 86 by the source CS which preferably includes a sterilant pump.

Figure 4:
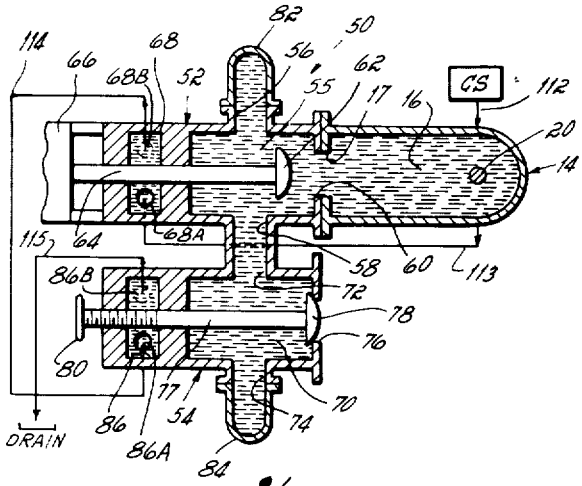
Figure 4A:
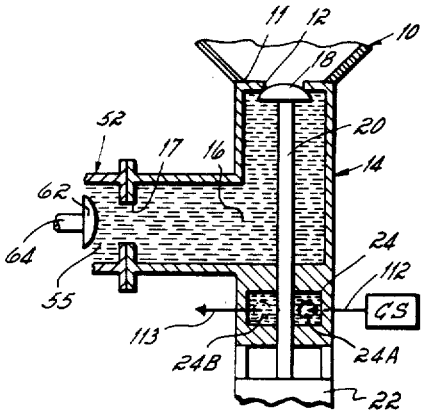

With the valve 52 open and the valve 54 closed, sterilant is poured into the valve chamber 55 and 70 via the elbows 82 and 84 which have been oriented such that their outer ports 82A and 84A are now upwardly directed, as shown in FIG. 4. Since valve plug 62 is in its open condition leaving port 60 in an unsealed state, the sterilant introduced into cavities 55 and 70 via elbows 82 and 84 is effective to fill the cavity 16 of tank drain valve 14, as shown in FIGS. 4 and 4A. By virtue of the fact that elbows 82 and 84 have been oriented with their ports 82A and 84A upwardly, and further by virtue of the fact that port 76 of valve 54 is closed by plug 78, the sterilant introduced into the cavities 55, 70 and 16 does not drain therefrom. To prevent infiltration of contaminant into the valve cavities 55, 70 and 16 via the bores in which valve stems 20, 64 and 77 seat, chemical sterilant from the source CS in continuously pumped through the stem sterilization chambers 24, 68 and 86 via hoses 112, 113, 114 and continuously drained therefrom via hose 115.

Figure 5A:
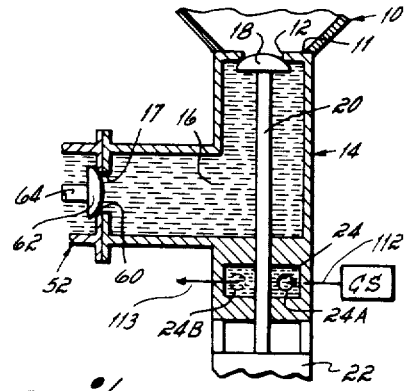

Once the cavity 16 of tank drain valve 14 is filled with sterilant via the un-sealed port 60 of valve 52, the valve 52 is placed in its closed position by advancing the valve plug 62 via pneumatic actuator 66 and valve stem 64. This is effective to seal the sterilant in chamber 16 of valve 14, as shown in FIGS. 5 and 5A.

Figure 6:
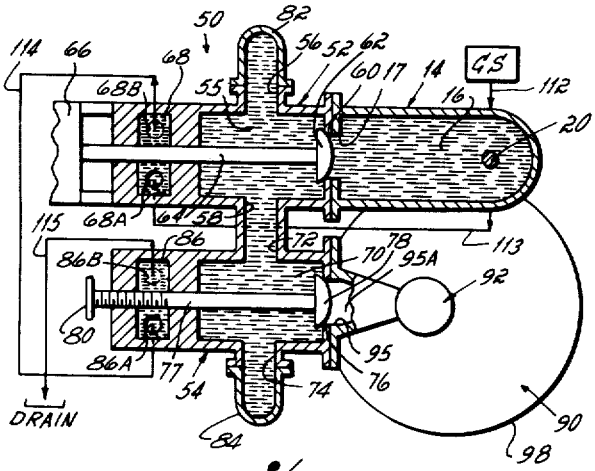
Figure 6A:
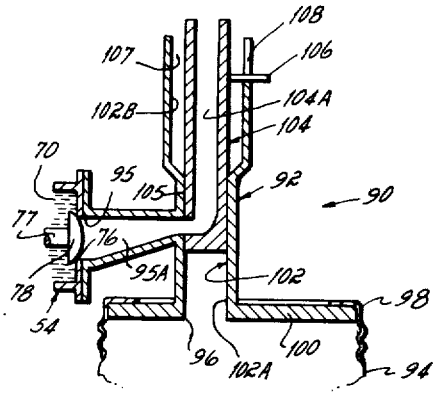
Figure 7A:
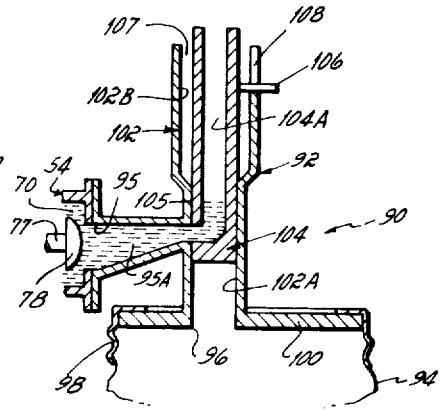

The jar valve assembly 90 is now connected to the tank fill sample valve assembly 50, as shown in FIGS. 6 and 6A. Specifically, the jar valve 92 is mounted to the sample valve 54 with the ports 76 and 95 thereof in alignment. The jar valve assembly 90 is oriented generally vertically such that the bore 102 is vertically disposed. With the valve element 104 in its elevated position (FIG. 6A), the cavity 95A of the jar valve 92 communicates with the environment via bore 104A of valve element 104.

The next step in the pre-fill sequence involves opening the sample valve 54 via retraction of plug 78, which is accomplished by rotating handle 80. With valve plug 78 retracted to its port-unsealing condition (FIGS. 7 and 7A), the sterilant in cavity 70 of the sample valve 54 flows into the cavity 95A of the jar valve 92, sterilizing port 76 against which valve 78 seats in the closed-valve condition of valve 54, as well as sterilizing the cavity 95A downstream thereof. The sterilant rises in the bore 104A to a level equal to that present in the elbows 82 and 84.

Figure 8:
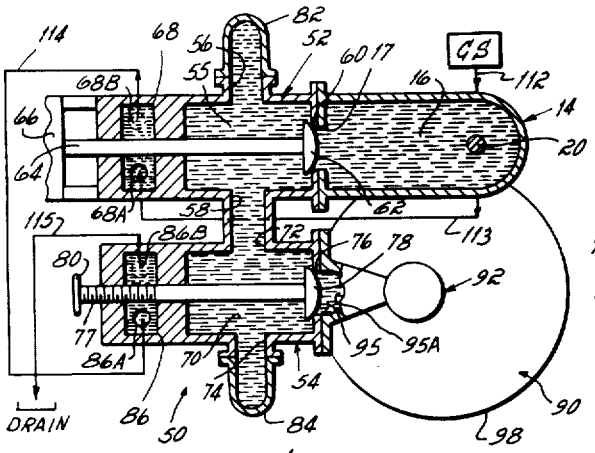
Figure 8A:
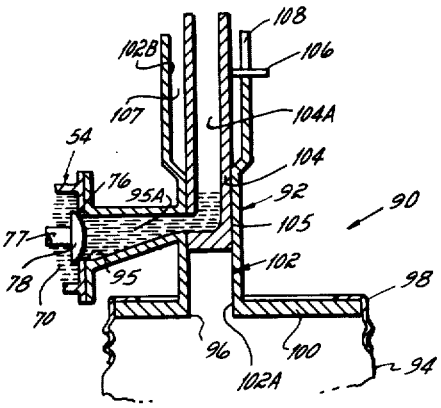
Figure 9:
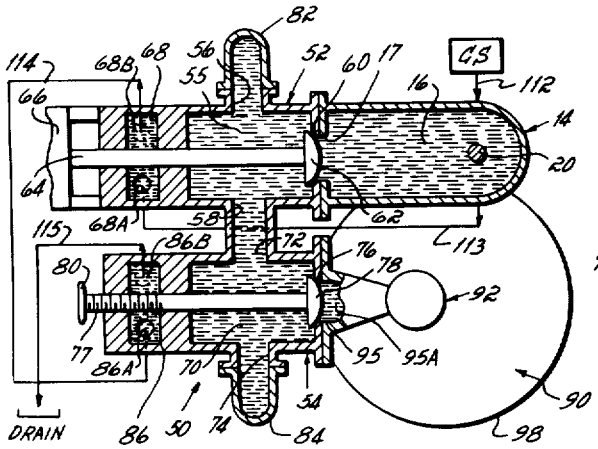
Figure 9A:
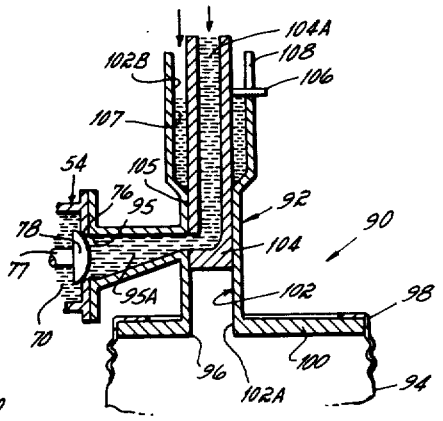

With the cavity 95A of jar valve 92, and the seat/port 76 of valve 54, and the port 95 of jar valve 92 in a sterile condition, the valve 54 is placed in its closed condition by advancing the valve plug 78 into seating engagement with the port 76, as shown in FIGS. 8 and 8A. To sterilize the entirety of bore 104A of valve plug element 104 of jar valve 92 the bore 104A is filled with chemical sterilant, as shown in FIG. 9A, by pouring into the upper end of the bore. Additionally, and to prevent infiltration of contaminant from the environment to cavity 95A via the interface 105 between valve element 104 and bore 102A, the annular cavity 107 is also filled with chemical sterilant, as shown in FIG. 9A, by pouring it in at the top thereof.

The interior of the jar 94 is preferably sterilized prior to mounting the jar valve assembly 90 to the tank fill sample valve assembly 50. This may be accomplished, for example, by placing the jar valve assembly 90, with the valve element 104 in its lower position sealing port 96 and the jar connected to the jar valve 92 via the coupling 98, in an autoclave for a period of time sufficient to sterilize the interior of the jar 94. The jar valve assembly 90, with the sterile jar 94 secured to the valve 92 and the valve element 104 in its lower condition, can then be secured to the tank fill-sample valve assembly 50 as previously described under conditions which maintain the aseptic nature of the interior of the jar.

Figure 10:
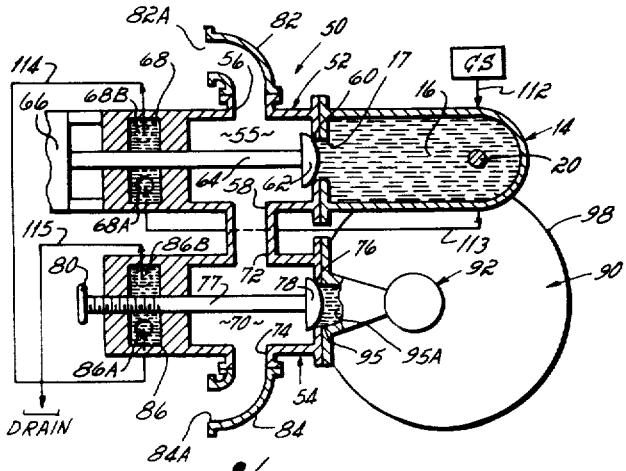

With the jar valve assembly 90 connected to the tank fill/sample valve assembly 50 and the jar valve cavity 95A and port 76 against which plug 78 seats in a sterile condition, the sterilant is drained from the cavities 55 and 70 of the tank and sample valves 52 and 54. This is accomplished by rotating the elbows 82 and 84 such that their outer ends 82A and 84A are directed downwardly as shown in FIG. 10. With the elbows so oriented, cavities 55 and 70 of valves 52 and 54 are drained of sterilant by gravity.

Figure 11:
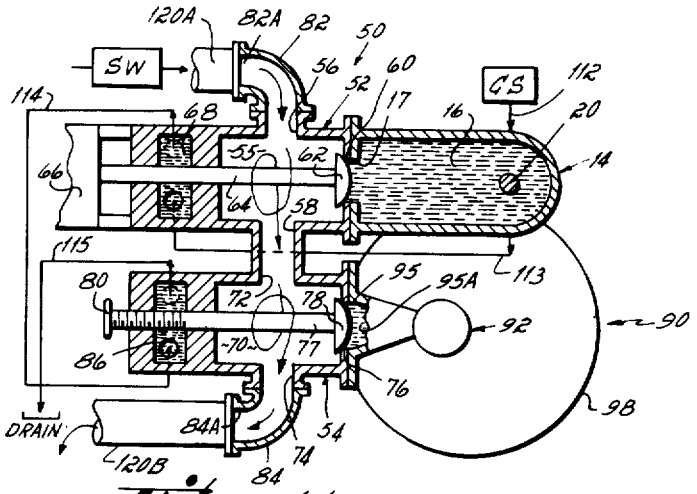

Valves 52 and 54 are now connected in the product supply line by connecting elbow 82 to the upstream portion of the product supply line 120A and elbow 84 to the downstream portion of the product supply line 120B, as shown in FIG. 11. Additionally, and as also shown in FIG. 11, a source of sterilizing water SW, e.g., superheated water or steam, is connected to the upstream end of the product supply line 120A and sterile water circulated through valves 52 and 54 to purge the valve chambers 55 and 70 and ports 56, 58, 72 and 74 thereof, and elbows 82 and 84, of remaining chemical sterilant. Since valve 52 remains closed by virtue of the seating engagement of plug 62 and port 60, the chemical sterilant remains in chamber 16 of tank drain valve 14, establishing a sterilant barrier between the interior of the aseptic tank 10 and the product line 120A and 120B seating engagement with port 60.

Figure 12:
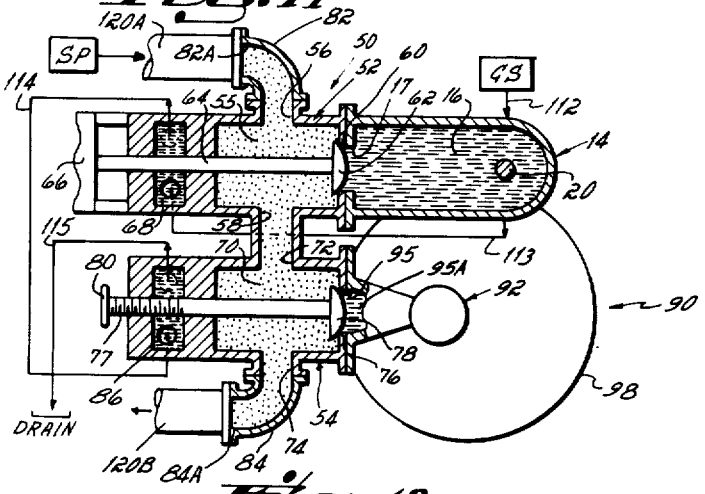

Subsequent to flushing sterilant from the cavities 55 and 70 of valves 52 and 54, the source of sterile water SW is disconnected from the upstream end of the product line 120A and in its place a source of sterile product SP connected thereto, as shown in FIG. 12. With a sterile product source SP so connected, sterile product flows through the cavities 55 and 70 of valves 52 and 54 via elbows 82 and 84, as shown in FIG. 12.

While not so shown in the figures, in practice the sterile product source SP and the sterile water source SW are connected to line 120A via a three-way aseptic valve. In this way the sources SW and SP can be connected for flow to line 120A on an alternative basis without need for actually physically connecting and disconnecting the sources relative to line 120.

TANK FILLING SEQUENCE

Throughout the entire period of the steps of FIGS. 3–12 of the pre-fill sequence, chemical sterilant source CS circulates sterilant through valve stem chambers 24, 68 and 86 of valves 14, 52 and 54 to maintain an aseptic barrier around valve stems 20, 64 and 77.

Figure 13:
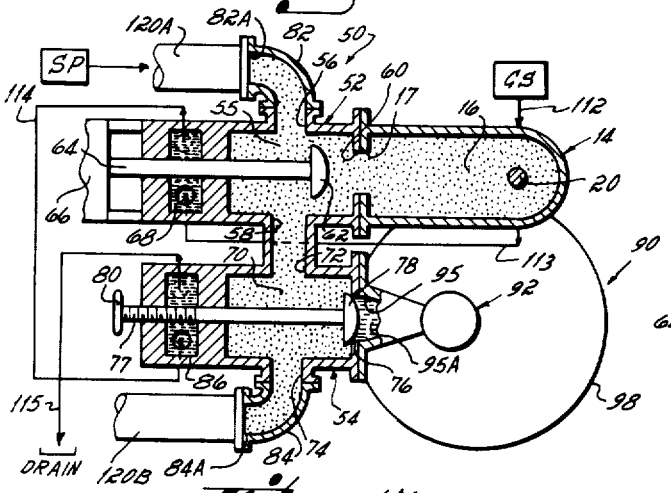
FIGS. 13 and 13A are elevational views, in cross section, showing the aseptic tank and associated valves during different phases of the tank-filling sequence.
Figure 13A:
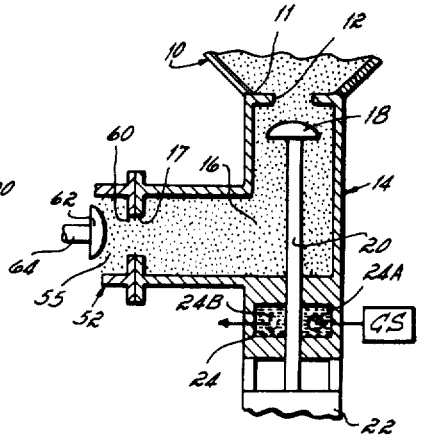

Following this, valve 52 is placed in its open condition by retracting plug 62 to unseal bore 60, as shown in FIGS. 13 and 13A. Sterile product now flows from cavity 55 of valve 52 into the cavity 16 of tank drain valve 14, to effectively purge the valve cavity 16 of sterilant which had heretofore been present. In addition to purging the chamber 16 of valve 14 of chemical sterilant with sterile product from the product line 120A which is fed by the sterile product source SP, continued retention of the valve 52 in its open condition as shown in FIG. 13 and 13A results in the introduction of sterile product into the interior of tank 10 to initiate the filling of the tank with sterile product via opening 11 therein. Circulation of chemical sterilant through valve stem chambers 24, 68 and 86 continues in the step of FIG. 13 to maintain the aseptic barrier around the stems of valve 14, 52 and 54.

PRODUCT SUPPLY SAMPLING SEQUENCE

Figure 14:
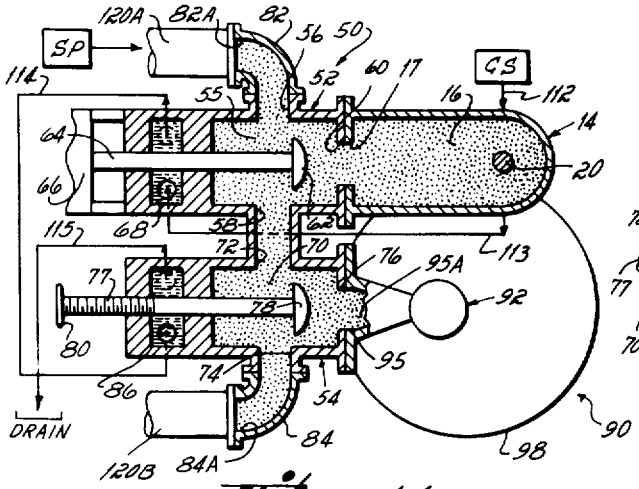
FIGS. 14–19A are elevational views, in cross section, of the aseptic tank and associated valves during different phases of the product supply sampling sequence.
Figure 14A:
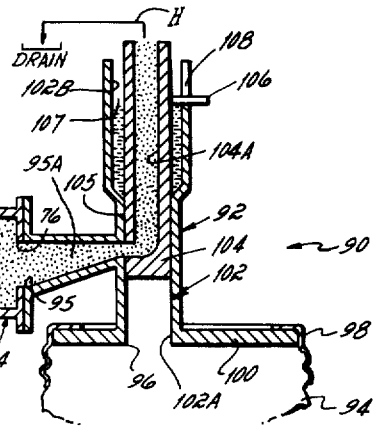
Figure 15:
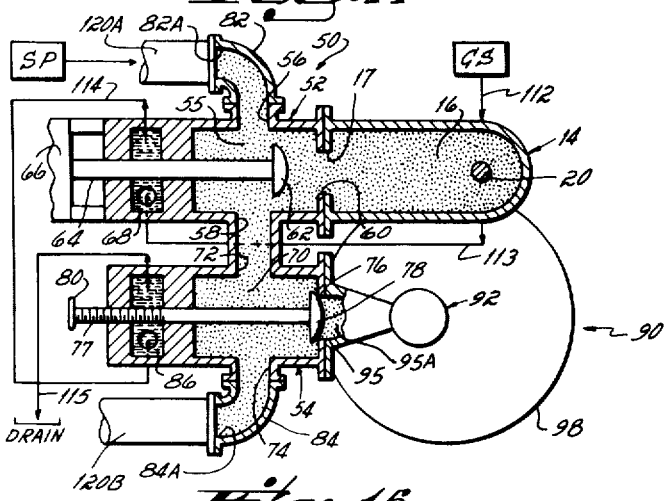

Before obtaining a sample of the sterile product flowing through valves 52 and 54 which are connected in series the product line 120A and 120B, it is necessary to purge chamber 95A and bore 104A of the jar valve 92 of the chemical sterilant which at this time is still present therein. This is accomplished, as shown in FIGS. 14 and 14A, by retracting valve plug 78 to open valve 54. With valve 54 open and valve element 104 in its lowered position, sterile product from valve cavity 70 flows through ports 76 and 95 to purge chemical sterilant from the cavity 95A and bore 104A of jar valve 92 to a drain via a hose H. The sterilant in annular cavity 107 is permitted to remain to avoid infiltration of contaminant from the environment via interface 105 between bore 102A and valve element 104. After purging the jar valve cavity 95A and bore 104A of sterliant, valve 54 is closed by seating plug 78 against port 76, as shown in FIG. 15.

Figure 16:
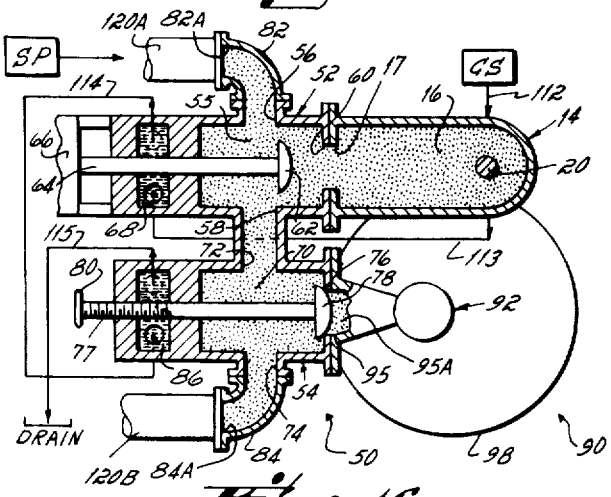
Figure 16A:
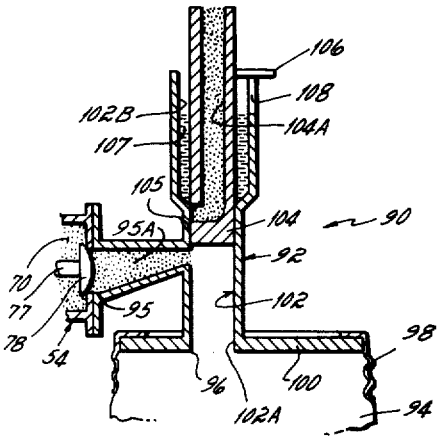
Figure 17:
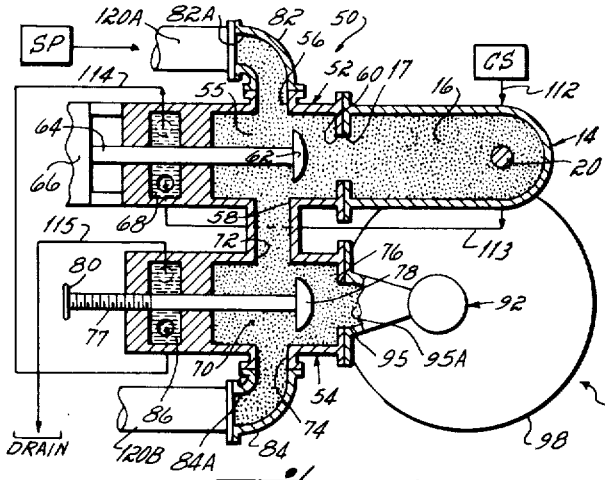
Figure 17A:
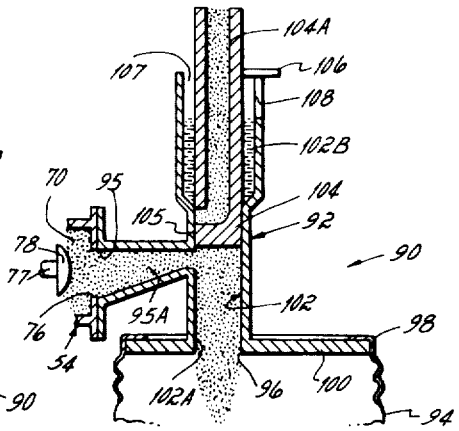

A sample of the sterile product flowing through valve cavities 55 and 70 of valves 52 and 54 which are series connected in the sterile product line 120A and 120B is obtained by placing the valve element 104 of jar valve 92 in its raised position to communicate the interior of the jar 94 with the jar valve cavity 95A, as shown in FIG. 16A. In addition, the valve 54 is placed in its open condition by retracting valve plug 78 from engagement with valve seat 76 of the sample valve 54, which is effective to communicate jar valve cavity 95 with the sample valve cavity 70, as shown in FIGS. 17 and 17A. Under these conditions of sample valve 54 and jar valve 92 sterile product passes into the jar 94, as shown in FIG. 17A.

Figure 18:
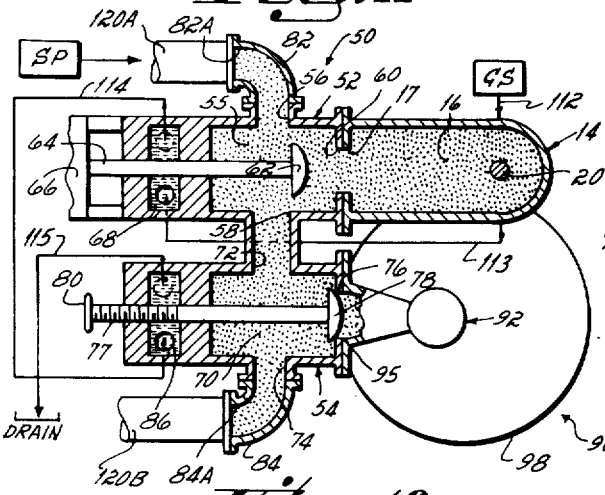
Figure 18A:
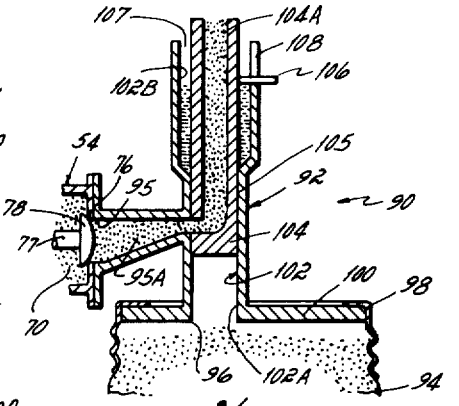
Figure 19:
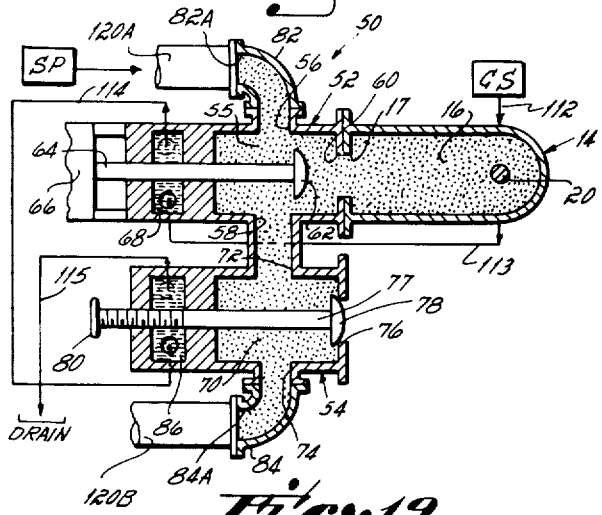
Figure 19A:
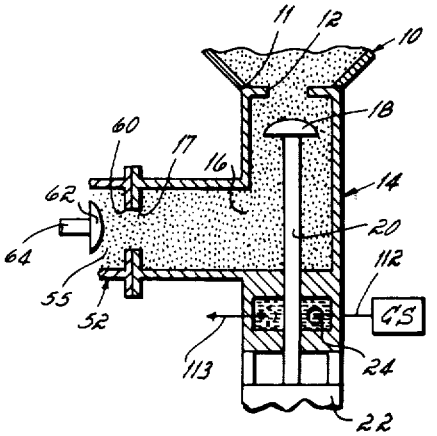

When the jar 94 has been filled with sterile product, the jar valve element 104 is placed in its lower position to seal jar valve port 96 relative to jar valve cavity 95A, as shown in FIG. 18A. In addition, valve 54 is placed in its closed condition by advancing valve plug 78 into seating enagement with port 76, as shown in FIG. 18. The jar valve assembly 90 is now disconnected from the tank fill/sample valve assembly 50 by detaching jar valve 92 from valve 54, as shown in FIG. 19. The detached jar valve assembly 90, with the product sample in jar 94 sealed by location of jar valve element 104 in its lowered condition, can be removed for appropriate testing or the like. Product continues to flow from product line 120A into the tank 10 via valves 52 and 14 which are both open, as shown in FIGS. 19 and 19A. Additionally, chemical sterilant, which has during the product sampling steps of FIGS. 14–19A, been flowing through stem chambers 24, 68 and 86 of valves 14, 52 and 54, continues to flow to maintain the aseptic barrier around valve stems 20, 64 and 77.

PRODUCT SUPPLY RESAMPLING SEQUENCE

Figure 20:
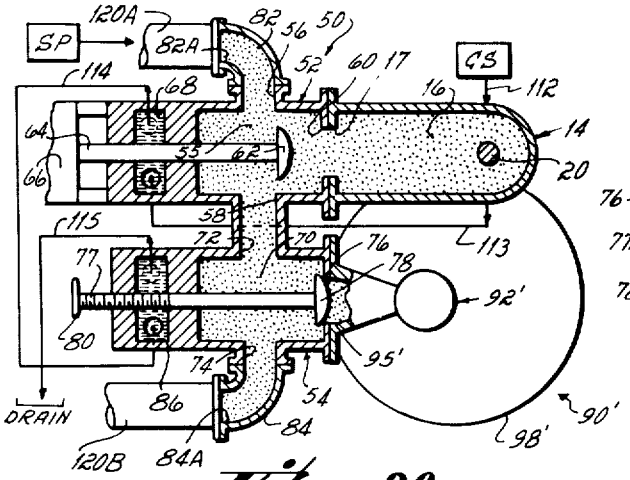
FIGS. 20–22 are elevational views, in cross section, of the aseptic tank and associated valves during different phases of the product supply resampling sequence.
Figure 20A:
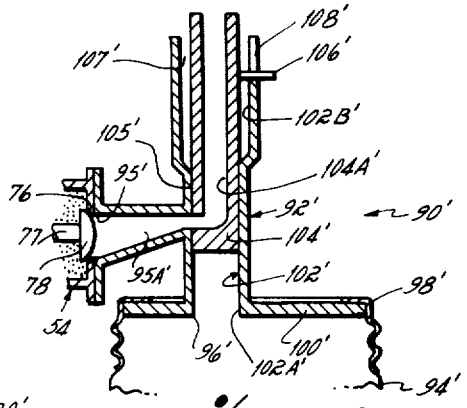
Figure 21:
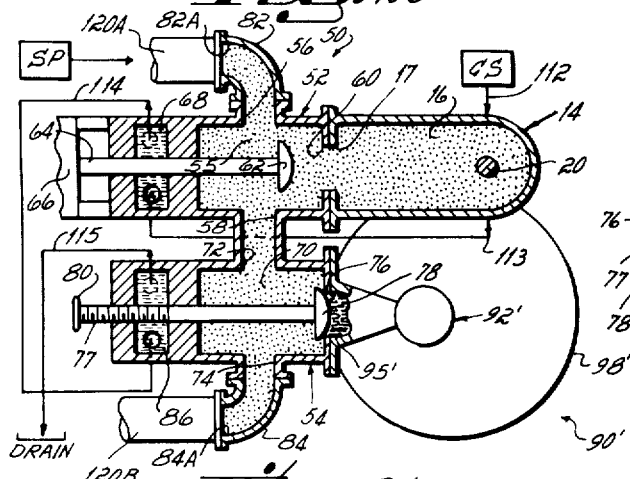
Figure 21A:
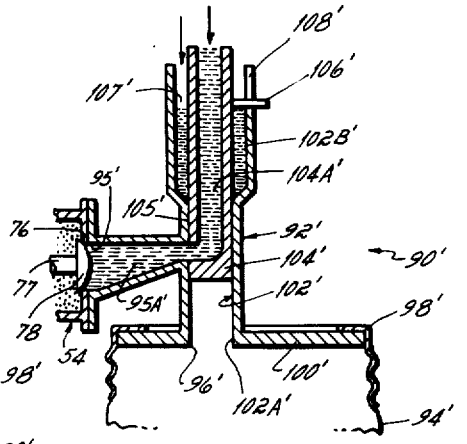
Figure 22:
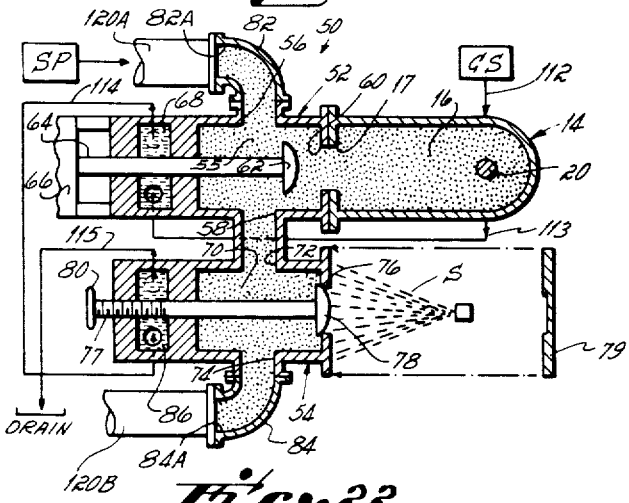

Following detachment of the jar valve assembly 90 from the tank fill/sample valve assembly 50 shown in FIGS. 19 and 19A, and cleaning port 76 with a chemical sterilant spray, a new jar valve assembly 90', which in all material respects is identical to jar valve 90, is mounted to the tank fill/sample valve assembly 50 by securing jar valve 92' to the sample valve 54 with the ports 76 and 95' thereof in alignment and the valve element 104' disposed vertically, as shown in FIGS. 20 and 20A. After connecting the new jar valve assembly 90' to the tank fill/sample valve assembly 50, sterilant is poured into the annular cavity 107' of the jar valve 92' to establish a sterile barrier between the interface 105' of the valve element 104' and the bore 102A'. Additionally, sterilant is poured down into the passage 104A' of valve element 104' to sterilize the cavity 95A' of jar valve 92', as shown in FIGS. 21 and 21A. The jar 92' is now filled with a sample of the sterile product by following the steps described in connection with the FIGS. 16–18A. After having taken a sample of the sterile product and filled jar 92', the jar assembly 90' is removed from the tank fill/sample valve assembly 50 pursuant to the steps described in connection with FIGS. 19 and 19A. The exposed portion of plug 78 and port 76 of valve 54 is then cleaned by subjecting them to a chemical sterilant spray S, as shown in FIG. 22. Thereafter the sterile port 76 is capped with a suitable cap 79.

During the resampling steps described in connection with FIGS. 20—22, chemical sterilant is circulated through valve stem cavities 24, 68 and 86 of valves 14, 52 and 54 to maintain an aseptic barrier around stems 20, 64 and 77.

FILLED TANK SEALING SEQUENCE

Figure 23:
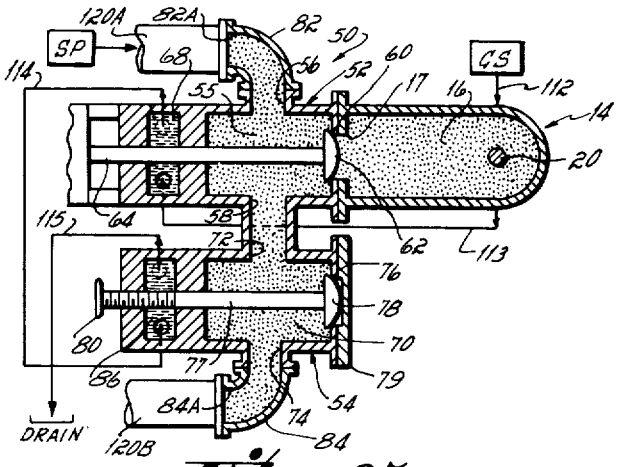
FIGS. 23–29 are elevatinal views, in cross section, of the aseptic tank and associated valves during different phases of the filled-tank, resealing sequence.
Figure 23A:
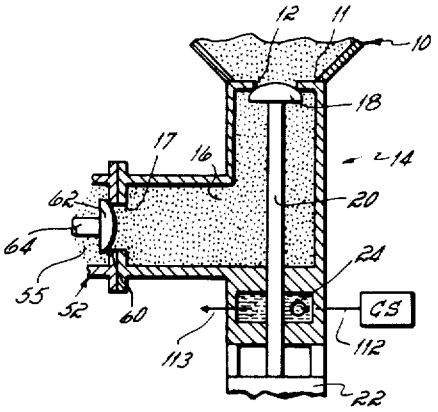

To initiate sealing of a filled tank 10, the valve 52 is closed by advancing the plug 62 into seating engagement with the port 60 as shown in FIG. 23. At the same time, the tank drain valve 14 is closed by advancing plug 18 into seating engagement with port 12, as shown in FIG. 23A. In addition, the sterile product source SP is disconnected from the upstream end of the sterile product line 120A, also as shown in FIG. 23.

Figure 24:
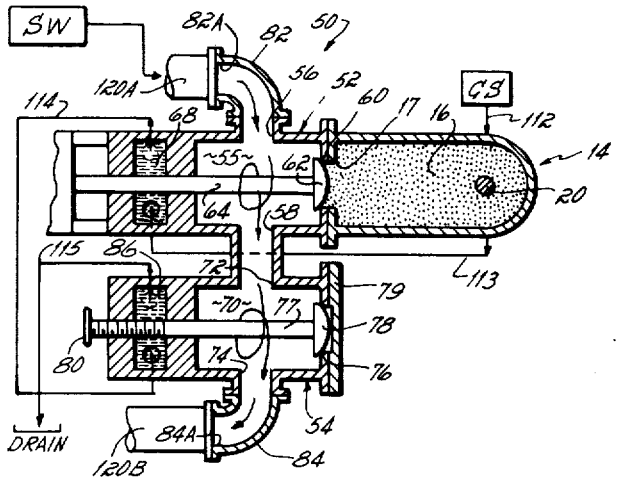

Following closure of valves 14 and 52 and the disconnection of the sterile product source SP, a source of sterile water SW is connected to the upstream end of the product line 120A as shown in FIG. 24. Connection of the sterile water source SW in this manner and the initiation of sterile water flow into line 120A is effective to flush product from the elbows 82 and 84 and the cavities 55 and 70 of the valves 52 and 54, also shown in FIG. 24.

Figure 25:
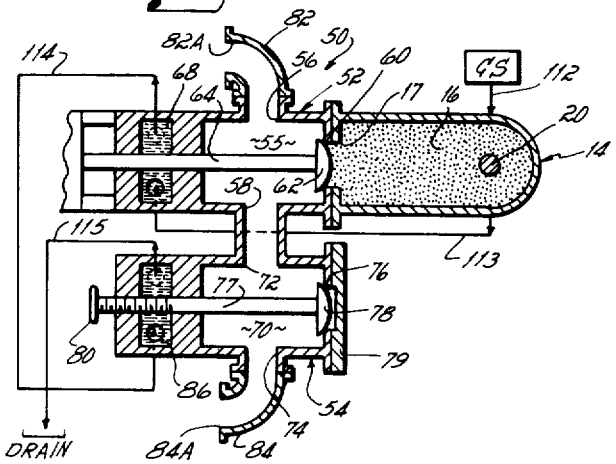
Figure 26:
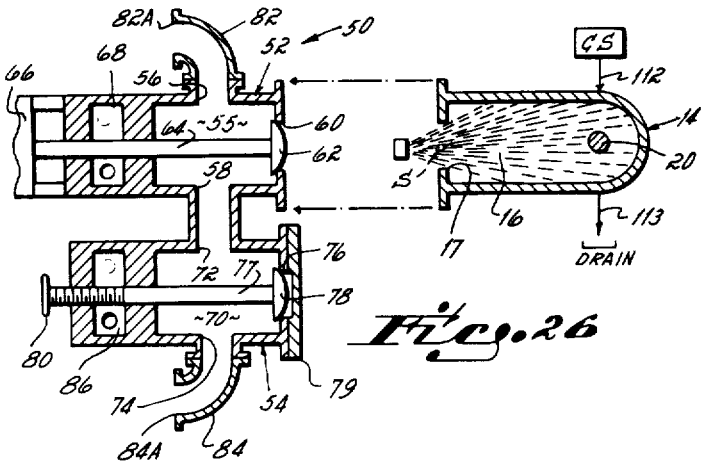
Figure 26A:
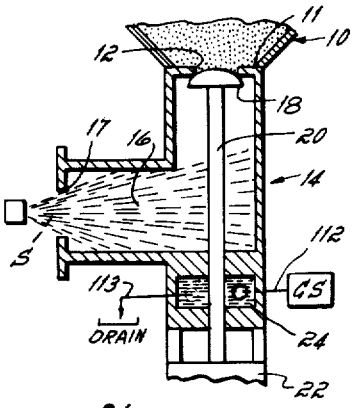

Following this, the source of sterile water SW and the upstream end of the product line 120A are disconnected from elbow 82, and the downstream product line 120B is disconnected from elbow 84, as shown in FIG. 25. The tank fill/sample valve assembly 50 is also disconnected from the tank drain valve 14 and the port 17 after disconnecting hose 113 from stem chamber inlet port 68A, as shown in FIG. 26. Cavity 16 of the tank drain valve 14 is cleaned by subjecting it to a chemical sterilant spray S as shown in FIGS. 26 and 26A. The chemical sterilant source CS continues to circulate sterilant through stem chamber 24 of valve 14 to maintain the aseptic barrier around stem 20. Chamber 24 exhausts sterilant to a drain via hose 113.

With the interior 16 of valve 14 now cleaned, the seal valve 26 is connected to the valve 14 in its open condition with the ports 34 and 17 thereof in alignment, and with the port 30 of valve 26 overlying and in vertical alignment with port 32, as shown in FIG. 27. Hose 113 is connected to inlet port 44A of chamber 44 of valve 26, the other end being connected to the output port 24B of sterilant chamber 24 of valve 14. The output port 44B of sterilant chamber 44 of valve 26 is connected to the cap 49 by hose 110 which seals port 32 of valve 26. Port 30 of valve 26 is left uncapped.

With hoses 112, 113 and 110 connected as indicated, the chemical sterilant source CS circulates chemical sterilant through the valve stem sterilization chambers 24 and 44 and then through the chambers 28 and 16 of valves 26 and 14, as shown in FIG. 28. With sterilant circulating through chambers 28 and 16, these valve chambers are thus sterilized and maintained in a sterile condition. Sterilant entering cavity 28 via hose 110, after circulating through cavities 28 and 16, flows to a drain via the uncapped port 30.

After valve 26 has been connected to valve 14 and the hoses installed to flood with sterilant the valve chambers 16, 28, 24 and 44, the sterilant source CS is removed and hose 112 disconnected from port 24A of stem chamber 24, the valve 26 is closed, and the port 30 of valve 26 is capped with a suitable cap 48, as shown in FIG. 29, and port 24A is also plugged by a plug (not shown).

At this point it is significant that valve cavities 16 and 28, each of which are sealed and filled with sterilant, provide two independent chemical barriers between the interior of the tank 10 which is now filled with sterilant product, and the environment. In addition, valve stem chambers 24 and 44 of valves 14 and 26 are sealed and filled with sterilant to provide an aseptic barrier around stems 20 and 40.

FILLED TANK SAMPLING SEQUENCE

Figure 30:
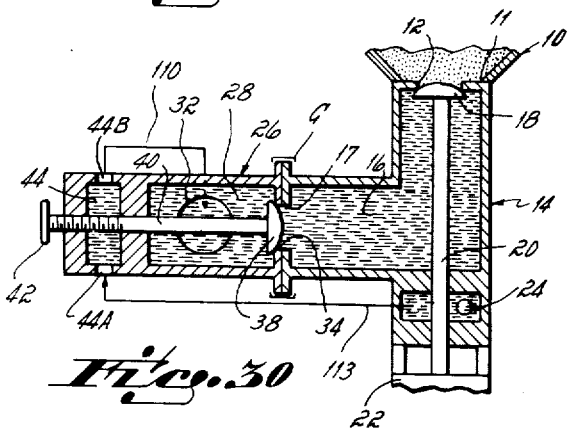
FIGS. 30–39 are elevational views, in cross section, of the aseptic tank and associated valves during different phases of the filled tank sampling sequence.
Figure 30A:
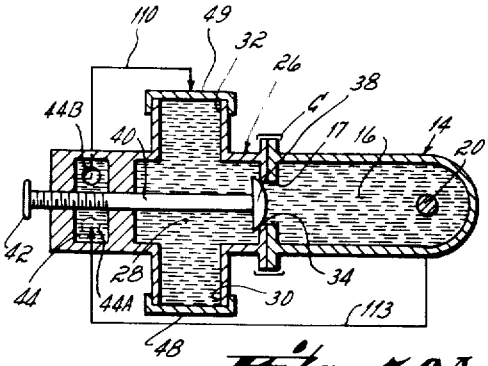

To obtain a sample of sterile product from the filled and sealed tank 10, the valve 26 is rotated 90° about the stem 40 with respect to the valve 14, such that ports 30 and 32 of valve 26 are horizontally aligned, as shown in FIGS. 30 and 30A. Rotation of valve 26 relative to valve 14, while still maintaining valve plug 38 in sealed engagement with valve port 34, can be accomplished by slightly loosening a circular clamp C which secures the mating flanges of valves 26 and 14, and while the clamp C is loosened, rotating the valve 26 90° about its stem 40, and thereafter tightening the clamp C with the valve so rotated, in accordance with the disclosure of copending U.S. Pat. application of Rechtsteiner et al Ser. No. 467,460 filed May 6, 1974, entitled "Aseptic Bulk Material Storage System and Improved Aseptic Valve Therefor."

Figure 31A:
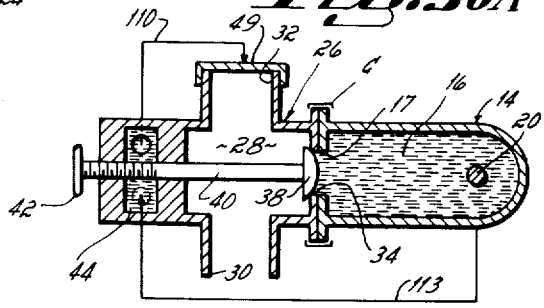

With the valve 26 so rotated and plug 38 sealing port 34, the valve cavity 28 is drained of chemical sterilant by removing the cap 48 from valve port 30, as shown in FIG. 31A, allowing the sterilant to drain from cavity 28 by gravity. Since the valve 26 is still closed, the chemical sterilant in cavity 16 of valve 14 remains, to maintain a chemical barrier between the tank opening 11 and the environment which now communicates with the interior 28 of valve 26 via open port 30.

Figure 32:
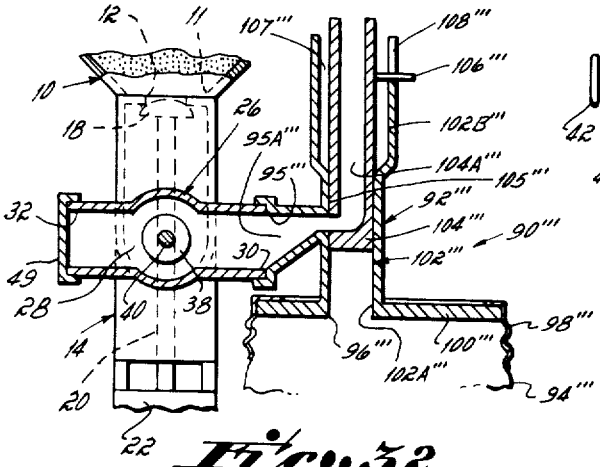
Figure 32A:
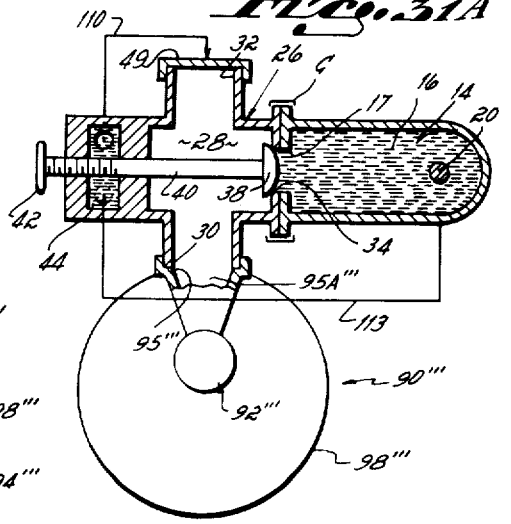

Following gravity drainage of valve cavity 28 via port 30, a new jar valve assembly 90''' is mounted to the valve 26 with the valve element 104''' of the jar 94''' vertically disposed and the ports 30 and 95''' of the valves 26 and 92''' aligned, as shown in FIGS. 32 and 32A. Since valve 26 is still closed by seating engagement of plug 38 with port 34, the opening 11 in the tank 10 is still protected by the chemical sterilant present in the valve chamber 16 of the tank drain valve 14.

Figure 33:
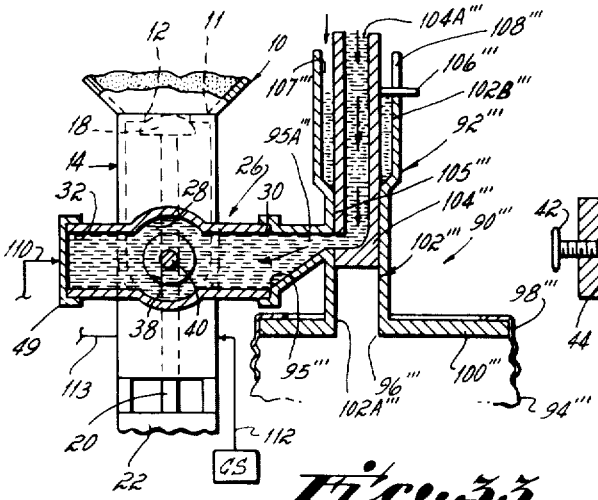
Figure 33A:
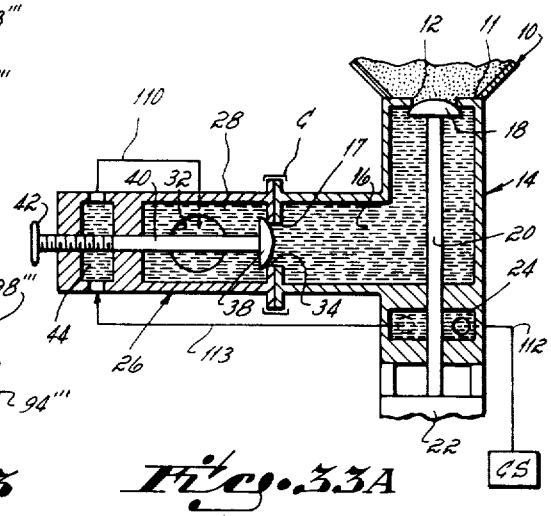

As shown in FIGS. 33 and 33A, chemical sterilant is now introduced into the bore 104A''' of valve element 104''' of the jar valve 92''' to flood chamber 95A''' with chemical sterilant as well as flood the bore 104A'''. Chemical sterilant is also introduced into the annular cavity 107''' to establish a sterile barrier between the environment and the interface 105''' of the valve element 104''' and the bore 102A'''. Additionally, the sterilant source CS is connected via hose 112 to input port 24A of chamber 24 to facilitate the circulation of chemical sterilant through the valve stem cavities 24 and 44 of valves 14 and 26, and the cavity 28 of valve 26 which drains via uncapped port 30.

Figure 34:
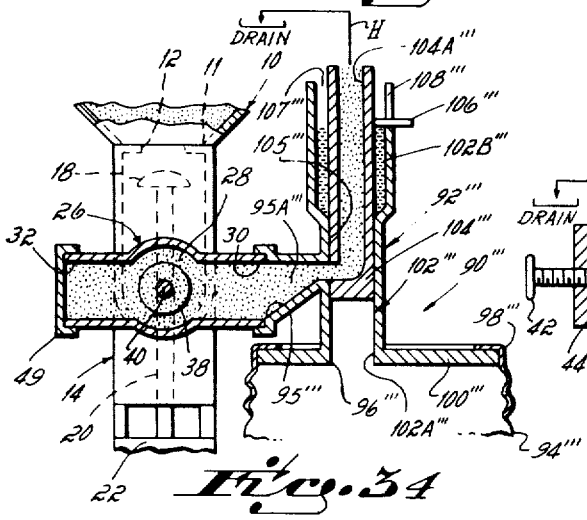
Figure 34A:
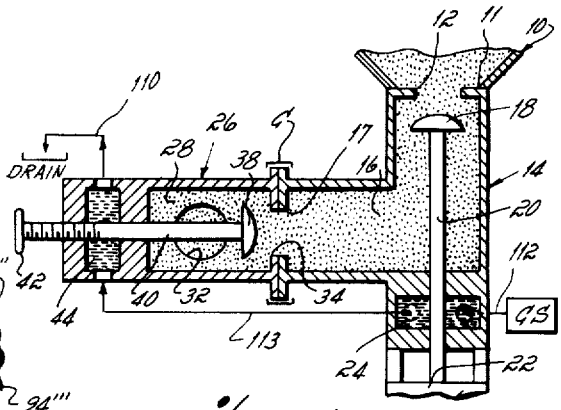
Figure 35A:
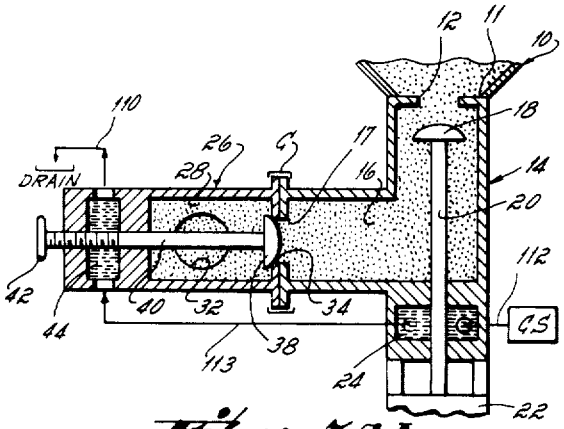

After a suitable period of sterilant circulation, the hose 110 is disconnected from port 32, and instead connected to a drain, as shown in FIG. 34A. At this point the chemical sterilant is circulating through the stem chambers 24 and 44 of valves 14 and 26. Valve 14 is opened and thereafter valve 26 is opened to purge sterilant from the cavities 16 and 28 of valves 14 and 26 via gravity-induced flow of sterile product from the tank 10 which passes downwardly through the tank opening 11, forcing the chemical sterilant from chambers 16, 28, 95A and bore 104A to drain. After the sterilant has been purged from the valve cavities 16 and 28 of valves 14 and 26, valve 26 is closed as shown in FIG. 35A.

Figure 36:
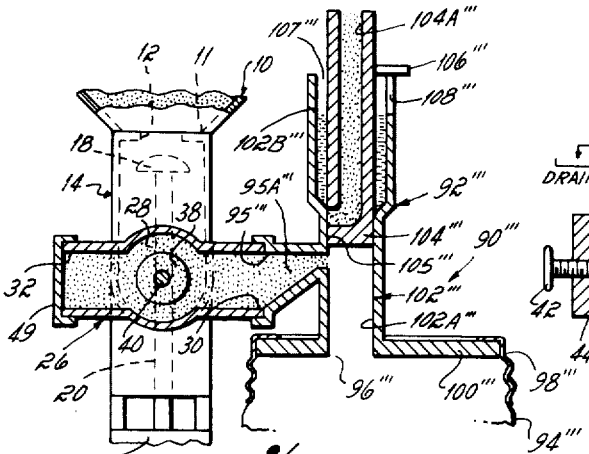
Figure 36A:
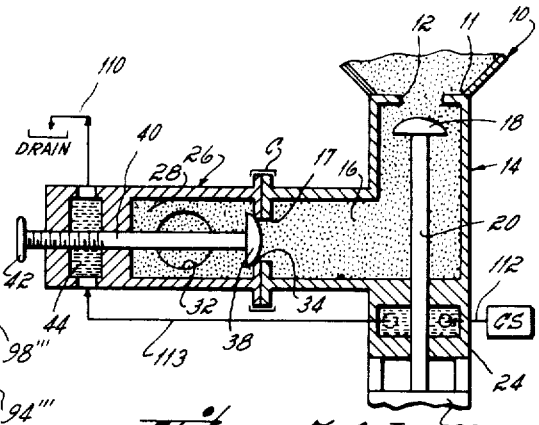
Figure 37:
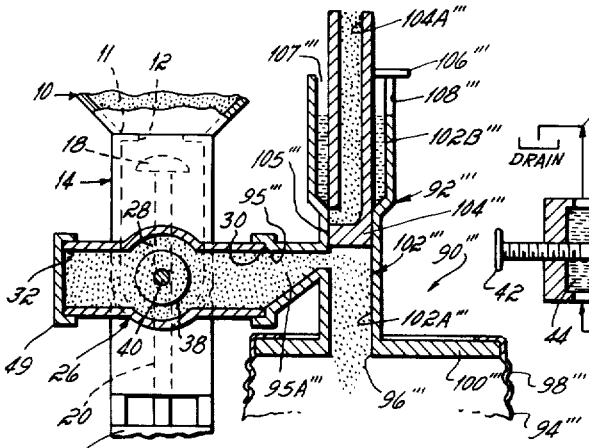
Figure 37A:
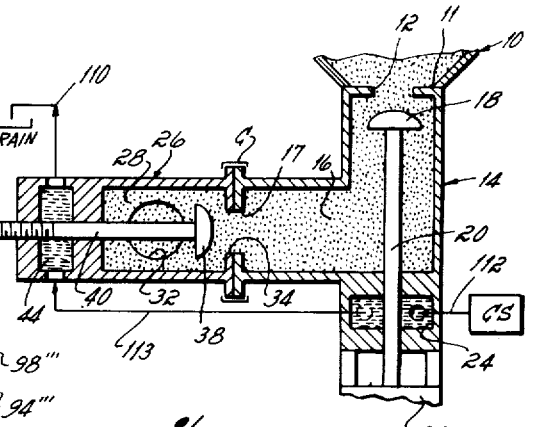
Figure 38:
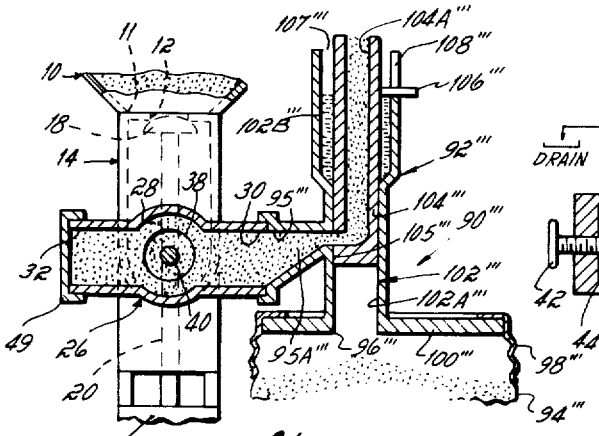
Figure 38A:
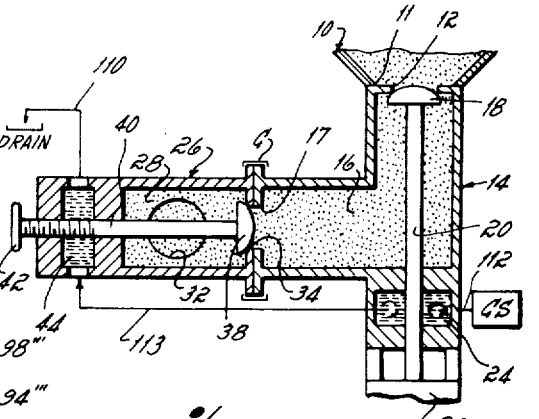
Figure 39:
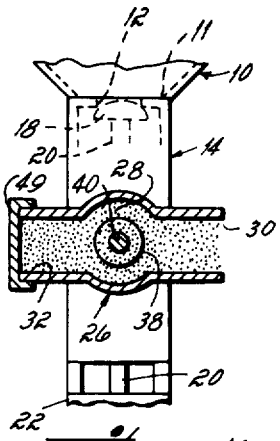

The valve element 104''' of jar valve 92''' is now placed in its elevated position to connect cavity 95A''' of the jar valve 92''' with the interior of the jar 94''' via port 96''', as shown in FIGS. 36 and 36A. Valve 26 is now opened to permit sterile product from the tank 10 to flow into the jar 94''' via valve 14 which is already open and via newly-opened valve 26, as shown in FIGS. 37 and 37A. When the jar valve is filled with sample sterile product from the tank 10, valve 26 is closed, as shown in FIG. 38A. Additionally, the valve element 104''' of jar valve 92''' is placed in its lower position to seal port 96''' and hence seal the contents of the jar as shown in FIG. 38. Tank drain valve 14 is also closed at this time, as shown in FIG. 38A. The jar valve assembly 90''' is now removed from port 30 of valve 26 as shown in FIG. 39. The sample, which is sealed in jar 94''', can be removed for testing as desired. Throughout the steps described in connection with FIGS. 33–39 chemical sterilant is continuously circulated by the source CS through the chemical sterilant valve stem chambers 24 and 44 of valves 14 and 26, to maintain an aseptic barrier around stems 20 and 40.

FILLED TANK RESEALING SEQUENCE

Figure 40:
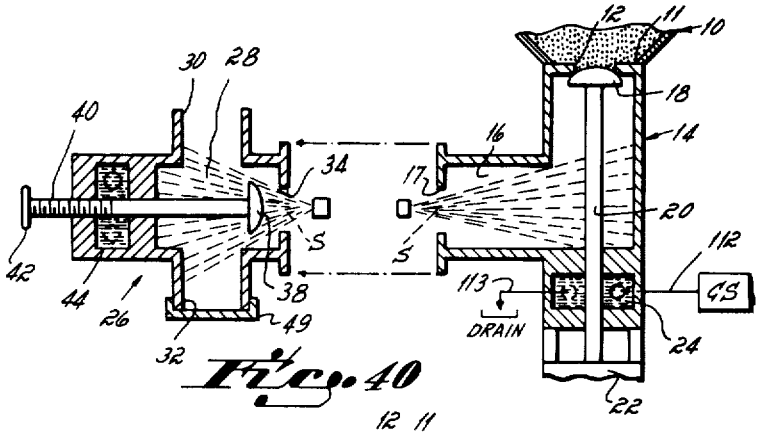
FIGS. 40–43 are elevational views, in cross section, of the aseptic tank and associated valves during different phases of the filled-tank resealing sequence.

The hose 113 is now disconnected from the inlet port 44A of sterilant cavity 44 of valve 26 and connected instead to drain, as shown in FIG. 40. Thus, chemical sterilant from the source CS is now circulating only through stem sterilant cavity 24 of valve 14, as shown in FIG. 40. Additionally, valve 26 is disconnected from valve 14 and the now-accessible cavity 16 of valve 14 and cavity 28 of valve 26 are subjected to a chemical spray S to remove sterile product therefrom and clean this cavity.

Figure 41:
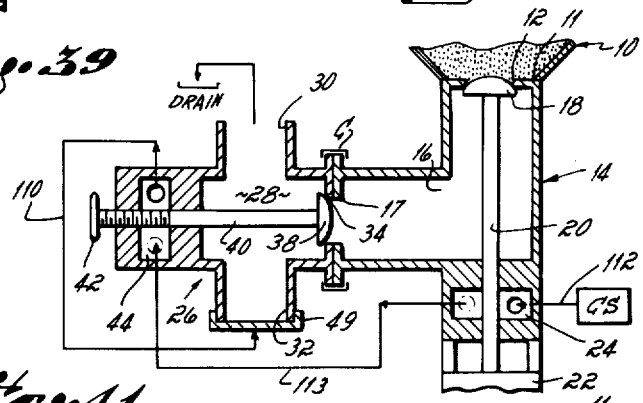
Figure 42:
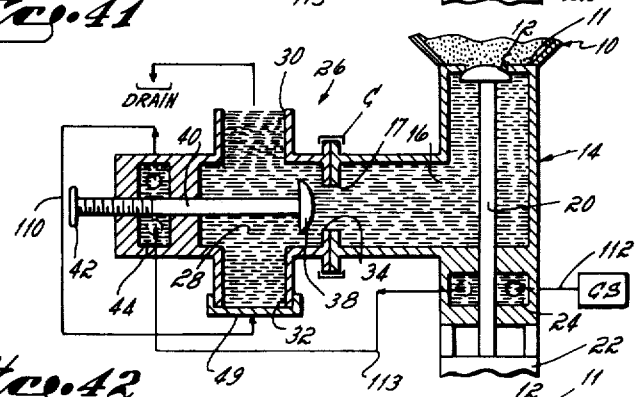
Figure 43:
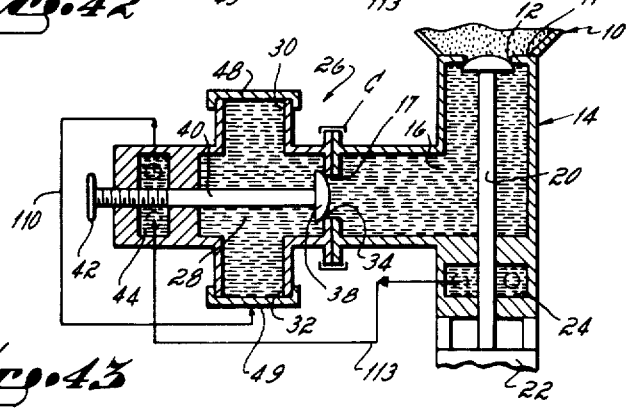

Following this, valve 26 which is open is reconnected to valve 14 with ports 34 and 17 in alignment, and with port 30 overlying port 32, as shown in FIG. 41. Port 32 remains capped with cap 49. Hose 113 is now reconnected to the input port 44A of stem sterilant chamber 44 of valve 26. Additionally, hose 110 is connected to port 32 via cap 49, the other end of the hose remaining connected to output port 44B of stem sterilant 44 of valve 26. The chemical sterilant source CS now floods the sterilant chambers 24 and 44 of valves 14 and 26 and in addition floods the valve Following sterilization of valve cavities 16 and 28, port 30 is capped with cap 48, as shown in FIG. 43. The steriland supply CS is disconnected and the hose 112 removed from the port 24A of valve stem sterilization chamber 24 of valve 14 and this port sealed with a suitable plug or the like. Additionally, valve 26 is placed in its closed condition. At this point the opening 11 in the bottom of the tank 10, which tank is filled with a sterile product, is protected from the environment by chemical sterilant in series-connected sealed chambers 16 and 28 of valve 14 and 26. Also, the valve stems 20 and 40 are surrounded by sterilant in chambers 24 and 44.

We claim:

1. A method of aseptically sealing and sampling an aseptic storage tank containing sterile product comprising the steps of:

connecting first and second aseptic valves in series with an opening in the tank, closing the first valve to seal the valve-closure cavity of the first valve from the tank opening to which a first port of the first valve communicates when the first valve is open, introducing liquid chemical sterilant into the valve-closure cavities of the first and second valves to sterilize and establish first and second aseptic barriers between the tank opening and the environment, closing the second valve to seal the second valve-closure cavity from the first valve-closure cavity, unsealing a port in said second valve, connecting a third valve to said unsealed port of said second valve to establish alternate flow paths including a) a first flow path between said unsealed port of said second valve and said environment and b) a second flow path between said unsealed port of said second valve and a sample container, introducing liquid chemical sterilant into said second valve-closure cavity via said first flow path to sterilize said unsealed port of said second valve and said second valve-closure cavity, operating said third valve to establish said second flow path, and opening said first and second valves to permit sterile product from said tank to enter said sample container via said first and second valve-closure cavities and said second flow path.

2. The method of claim 1 further including the tank re-sealing steps of:

closing said first valve to terminate the flow of sterile product from said tank, operating said third valve to re-establish said first flow path and seal said sample container, disconnecting the third valve from the unsealed port of said second valve, introducing liquid chemical sterilant into said first and second valve-closure cavities to sterilize and establish first and second aseptic barriers between the environment and said tank opening, and closing said second valve to seal said second valve-closure cavity from said first valve-closure cavity.

3. A method of aseptically sampling sterile product stored in an aseptic storage tank by removal thereof from an opening in the tank to which first and second valves are series-connected in their closed condition with their respective valve-closure cavities filled with chemical sterilant, to establish two aseptic barriers between the tank opening and the environment, comprising the steps of:

connecting a third valve to a port of said second valve to establish alternate flow paths including a) a first flow path between said port and the environment and b) a second flow path between said port and a sample container, operating said third valve to establish said first flow path, introducing sterilant into said first flow path to sterilize said port and said second valve-closure cavity, operating said third valve to establish said second flow path, and opening said first and second valves to permit sterile product to flow into said sample container via first and second valve-closure cavities and said second flow path.

4. The method of claim 2 further including the tank re-sealing steps of:

closing said first valve to terminate the flow of product from said tank opening, operating said third valve to establish said first flow path and seal said sample container, disconnecting said third valve from the port of said second valve, introducing sterilant into said first and second valve-closure cavities to sterilize and establish two aseptic barriers between said tank opening and the environment, closing said second valve to seal said second valve-closure cavity from said first valve-closure cavity, and sealing said second valve port.

* * * * *